US007435144B2

(12) United States Patent
Waltz

(10) Patent No.: US 7,435,144 B2
(45) Date of Patent: Oct. 14, 2008

(54) ELECTRICAL SPLICE CONNECTOR

(75) Inventor: Peter A. Waltz, Bristol, NH (US)

(73) Assignee: FCI Americas Technology, Inc., Carson City, NV (US)

( * ) Notice: Subject to any disclaimer, the term of this patent is extended or adjusted under 35 U.S.C. 154(b) by 2 days.

(21) Appl. No.: 11/656,116

(22) Filed: Jan. 22, 2007

(65) Prior Publication Data

US 2008/0176461 A1 Jul. 24, 2008

(51) Int. Cl.
*H01R 11/09* (2006.01)

(52) U.S. Cl. ..... 439/784; 174/84 R

(58) Field of Classification Search ..... 439/784, 439/863; 174/84 C, 84 R, 88 R
See application file for complete search history.

(56) References Cited

U.S. PATENT DOCUMENTS

| | | | | | |
|---|---|---|---|---|---|
| 2,148,173 | A | | 2/1939 | Rogoff | 24/126 |
| 2,261,414 | A | | 11/1941 | Rogoff | 287/75 |
| 2,554,387 | A | | 5/1951 | Saul | 287/75 |
| 2,988,727 | A | | 6/1961 | Berndt | 339/273 |
| 3,205,300 | A | * | 9/1965 | Becker | 174/84 S |
| 3,384,704 | A | | 5/1968 | Vockroth | 174/90 |
| 4,146,299 | A | * | 3/1979 | Wellington et al. | 385/59 |
| 4,346,958 | A | | 8/1982 | Blanchard | 339/177 R |
| 4,362,352 | A | * | 12/1982 | Hawkins et al. | 439/788 |
| 4,458,976 | A | | 7/1984 | Hudson et al. | 339/248 R |
| 4,744,622 | A | * | 5/1988 | Cherry et al. | 385/87 |
| 4,752,252 | A | * | 6/1988 | Cherry et al. | 439/784 |
| 4,979,911 | A | | 12/1990 | Spencer | 439/583 |
| 5,301,422 | A | | 4/1994 | Uzelac | 29/869 |
| 5,322,454 | A | | 6/1994 | Thommen | 439/584 |
| 5,683,273 | A | * | 11/1997 | Garver et al. | 439/784 |
| 6,105,247 | A | | 8/2000 | Varreng | 29/871 |
| 6,193,565 | B1 | | 2/2001 | Herron | 439/783 |
| 6,599,059 | B2 | | 7/2003 | Calandra, Jr. et al. | 405/259.4 |
| 6,773,311 | B2 | | 8/2004 | Mello et al. | 439/783 |
| 6,805,596 | B2 | | 10/2004 | Quesnel et al. | 439/877 |
| 7,019,217 | B2 | | 3/2006 | Bryant | 174/88 R |
| 7,041,909 | B2 | | 5/2006 | Hiel et al. | 174/88 R |
| 7,097,486 | B2 | * | 8/2006 | Parsons | 439/291 |
| 2004/0132366 | A1 | | 7/2004 | Hiel et al. | 442/43 |
| 2005/0006129 | A1 | | 1/2005 | Bryant | 174/88 R |
| 2005/0129942 | A1 | | 6/2005 | Hiel et al. | 428/375 |
| 2006/0084327 | A1 | | 4/2006 | Chadbourne | 439/784 |

FOREIGN PATENT DOCUMENTS

WO WO-2005/041358 A2 5/2005

OTHER PUBLICATIONS

FCI Burndy "ACCC Compression Splice, Instructions For Use", Item No. 10050603, Rev. E, 1 page.

* cited by examiner

*Primary Examiner*—Thanh-Tam T Le
(74) *Attorney, Agent, or Firm*—Harrington & Smith, PC

(57) ABSTRACT

An electrical connector union coupler assembly including a coupling subassembly and a collet retainer. The coupling subassembly includes a coupling sleeve rotatably connected to a coupling body. The coupling body includes a first end with a threaded section and a first surface adapted to press against a first set of electrical connector wedges. The coupling sleeve is constrained on the coupling body for substantially only rotational movement relative to the coupling body. The collet retainer has a first end movably connected to the coupling sleeve by a threaded connection. The collet retainer includes a second end with a threaded section and a second surface adapted to press against a second set of electrical connector wedges.

16 Claims, 3 Drawing Sheets

ELECTRICAL SPLICE CONNECTOR

BACKGROUND OF THE INVENTION

1. Field of the Invention

The invention relates to an electrical connector and, more particularly, to a splice electrical connector.

2. Brief Description of Prior Developments

Electrical splice connectors for connecting ends of two electrical conductors to each other are well known in the art. In the area of high voltage, overhead power distribution lines, conductors need to be spliced to each other and the distance between the ends of the conductors moved closer to each other to splice or couple the conductors.

Turnbuckle couplers have been used in the past for splicing together two high voltage, overhead power distribution lines, but a problem exists in that rotation of a coupling sleeve of the turnbuckle coupler onto a first collet retainer of the turnbuckle coupler can result in unscrewing a second collet retainer of the turnbuckle coupler from the coupling sleeve. Another problem is that the conventional turnbuckle coupler can possibly inadvertently tighten one of the collet retainers against conductor contacting wedges and perhaps crushing the conductor, or alternatively inadvertently reduce pressing contact of one of the collet retainers against conductor contacting wedges and loosening grip on the conductor by the wedges. There is a desire for an electrical splice connector which can couple the ends of electrical connectors to each other without risk of moving conductor gripping wedges of the connector during the adjustment, or inadvertently moving a coupler of the connector which was not intended to be moved.

SUMMARY OF THE INVENTION

In accordance with one aspect of the invention, an electrical connector union coupler assembly is provided including a coupling subassembly and a collet retainer. The coupling subassembly includes a coupling sleeve rotatably connected to a coupling body. The coupling body includes a first end with a threaded section and a first surface adapted to press against a first set of electrical connector wedges. The coupling sleeve is constrained on the coupling body for substantially only rotational movement relative to the coupling body. The collet retainer has a first end movably connected to the coupling sleeve by a threaded connection. The collet retainer includes a second end with a threaded section and a second surface adapted to press against a second set of electrical connector wedges.

In accordance with another aspect of the invention, an electrical connector union coupler assembly is provided comprising a first coupling body, a coupling sleeve, a fastener, and a second coupling body. The first coupling body comprising a first end and a second end. The first end comprises a threaded section and a surface adapted to press against a first set of electrical connector wedges. The coupling sleeve has a first end and a second end, wherein the second end comprises a threaded section. The fastener connects the first end of the coupling sleeve to the second end of the first coupling body. The coupling sleeve is adapted to rotate relative to the coupling body and is substantially prevented from moving away from the coupling body by the fastener. The second coupling body has a first end adapted to be screwed into the second end of the coupling sleeve, and a second end having a threaded section and a surface adapted to press against a second set of electrical connector wedges.

In accordance with another aspect of the invention, a method of manufacturing an electrical connector union coupler assembly is provided comprising rotatably connecting a coupling sleeve to a first coupling body, wherein the coupling sleeve is substantially prevented from moving away from the first coupling body, wherein the first coupling body comprises a first end having a threaded section and a surface adapted to push against ends of first electrical connector wedges; and movably connecting a first end of a second coupling body to the coupling sleeve by a threaded connection, wherein the second coupling body has a second end with a threaded section and a surface adapted to push against ends of second electrical connection wedges. The coupling sleeve is adapted to rotate relative to the first and second coupling bodies to reduce a distance of the first and second coupling bodies relative to each other.

In accordance with another aspect of the invention, an electrical splice connector is provided comprising a first end subassembly and a second end subassembly. The first end subassembly is adapted to be connected to an end of a first electrical conductor cable, wherein the first end subassembly comprises a first set of wedges adapted to be compressed around the end of the first electrical conductor cable. The second end subassembly is adapted to be connected to an end of a second electrical conductor cable, wherein the second end subassembly comprises a second set of wedges adapted to be compressed around the end of the second electrical conductor cable. The first and second end subassemblies are adapted to be connected to each other such that a first portion of the first end subassembly can be rotated relative to a second portion of the first end subassembly and relative to the second end subassembly to move the first and second sets of wedges towards each other as the first portion of the first end subassembly is rotated.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
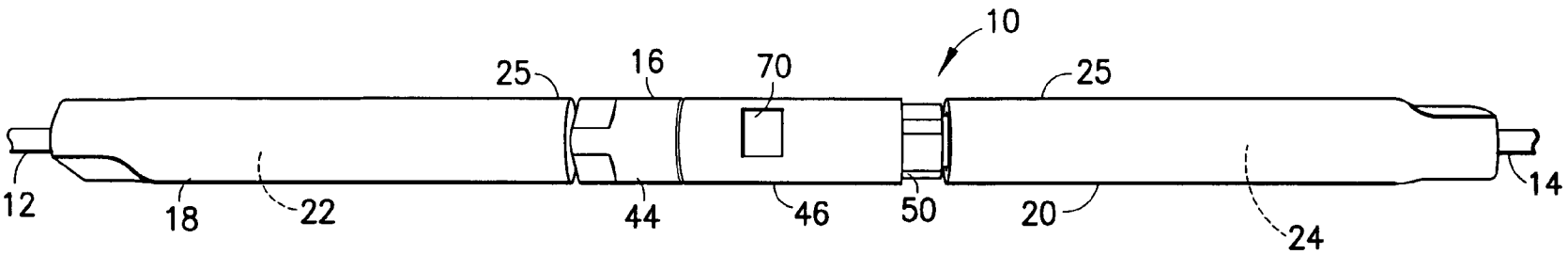
FIG. 1 is a side view of an electrical connector incorporating features of the invention connecting two electrical conductors to each other.

Referring to FIG. 1, there is shown a side view of an electrical connector 10 incorporating features of the invention connecting two electrical conductors 12, 14 to each other. Although the invention will be described with reference to the exemplary embodiment shown in the drawings, it should be understood that the invention can be embodied in many alternate forms of embodiments. In addition, any suitable size, shape or type of elements or materials could be used.

The connector 10 is preferably used in the high voltage, overhead power distribution line area, such as when the conductors 12, 14 are high voltage, overhead power distribution lines. Overhead power distribution lines are know which have a reinforcing core and surrounding conductor strands, but the invention can be used with any suitable type of cable. The connector 10 generally comprises a union coupler assembly 16, two housings or collet housings 18, 20 and two wedge assemblies (collets) 22, 24. In this embodiment the collet housings 18, 20 are identical to each other. However, in alternate embodiments they could be different. Each collet housing 18, 20 has a general tube shape with a tapered inner channel and a threaded inner end 25. The tapered inner channel tapers inward along the length of the collet housing from the end 25 to the opposite end.

Figure 2:
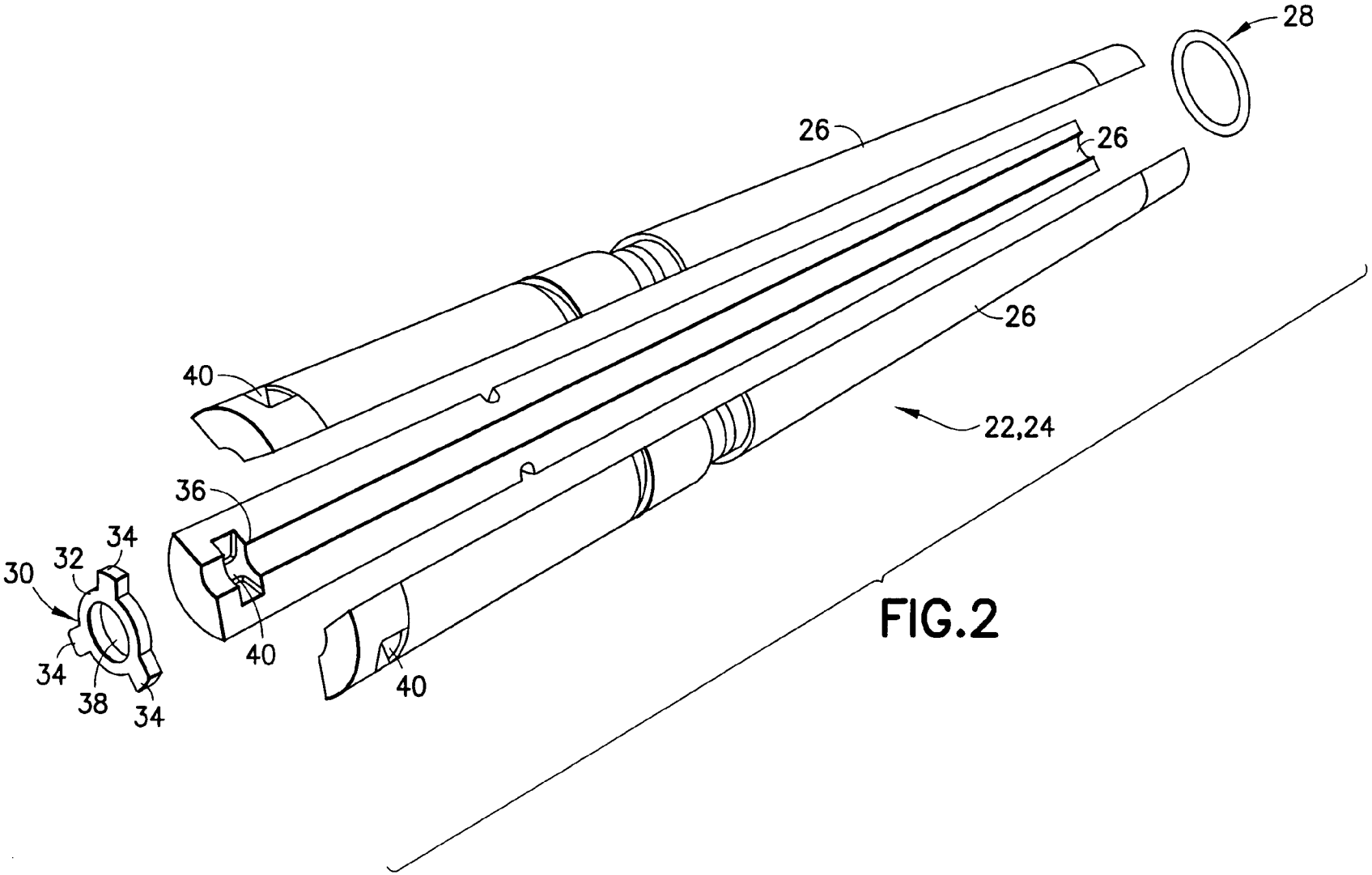
FIG. 2 is an exploded perspective view of a wedge assembly used in the connector shown in FIG. 1.

Referring also to FIG. 2, in this embodiment the wedge assemblies 22, 24 are identical to each other. However, in alternate embodiments they could be different. In this embodiment each wedge assembly comprises three wedges 26, an extension spring member 28 and an interlock retainer 30. However, in alternate embodiments any suitable wedge assembly could be provided, or perhaps merely wedges. The extension spring member 28 can resiliently expand outwardly and contract inwardly. The extension spring member 28 is located in an exterior annular recess formed by the wedges to retain the wedges 26 with one another, but which allows the wedges to expand outwardly when the cable or conductor reinforcing core 12 or 14 is first inserted between the wedges. In an alternate embodiment any suitable type of spring, system or member for retaining the wedges 26 together before insertion into one of the collet housing 18 or 20 could be provided. For example, the extension spring member could comprise a spring clip, or a garter spring, or an O-ring which could be used as an elastomeric extension spring (similar to a rubber band for example).

The interlock retainer 30 generally comprises a ring shaped section 32 and outward projections or key sections 34. The ring shaped section 32 is located in the annular recess formed by the recesses 36 in the wedges 26. The hole 38 in the ring shaped section 32 is sized and shaped to easily allow the cable or conductor reinforcing core 12 or 14 to pass therethrough. The projections 34 extend into the pockets 40 in the wedges 26. The wedges 26 can move radially inward and outward relative to the ring shaped section 32 with the pockets 40 moving relative to the outward projections 34. The interlock retainer 30 is provided to keep the wedges 26 longitudinally aligned with one another as the assembly moves longitudinally inside the housing 18 or 20. Thus, all three wedges are moved together by the interlock retainer as the wedges are pulled or pushed into the housing 18 or 20 to their final resting position in the housing. In an alternate embodiment the interlock retainer could comprise any suitable type of shape so long as it interlocks the wedges 26 with each other for longitudinal movement in unison with each other. The extension spring member 28 helps to keep the wedges 26 and the interlock retainer 30 together before and during assembly into the housing 18 or 20. In another alternate embodiment the functions of the two retainers 28, 30 could be combined into a single member or the extension spring member 28 might not be provided.

Figure 3:
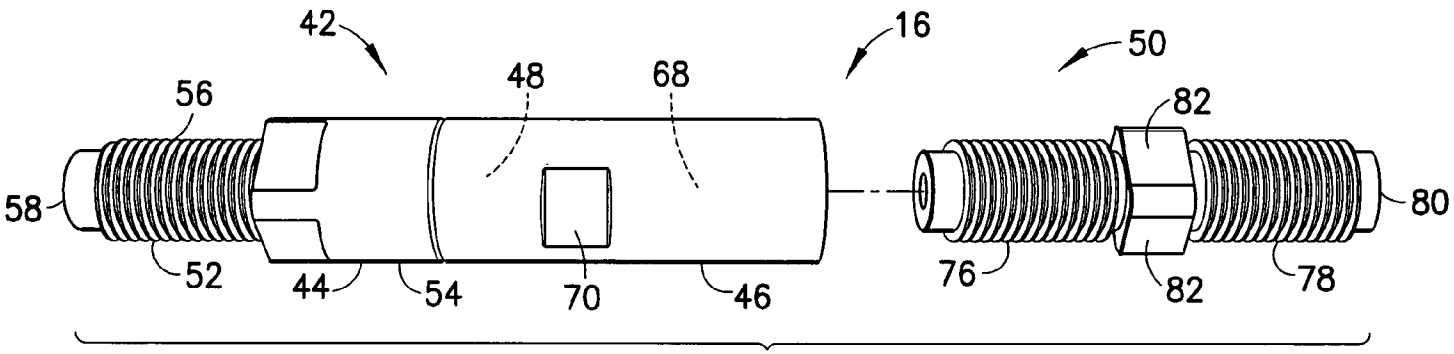
FIG. 3 is a side view of two subassemblies used in the connector shown in FIG. 1.
Figure 4:
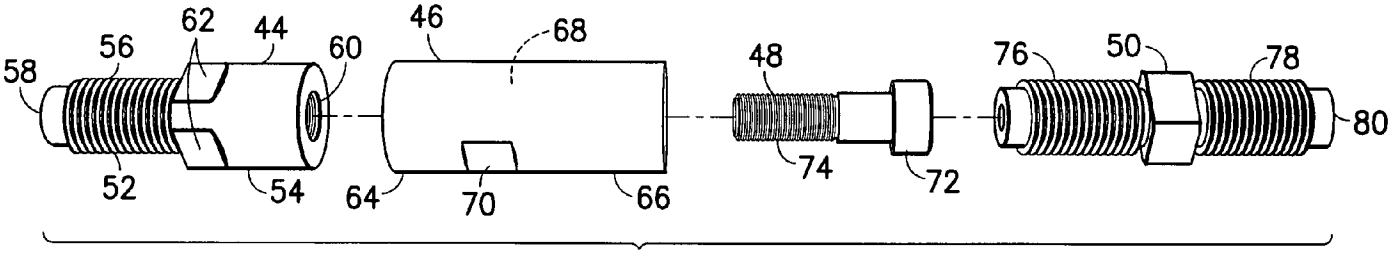
FIG. 4 is an exploded perspective view of the subassemblies shown in FIG. 3.
Figure 5:
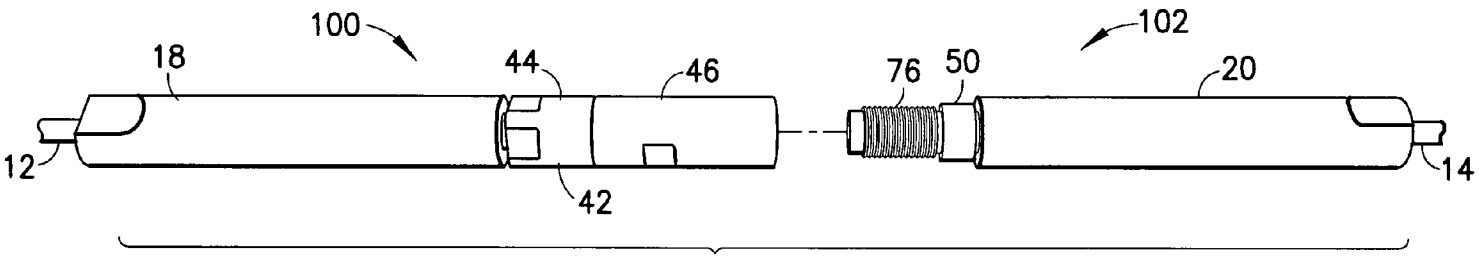
FIG. 5 is a side view showing two end subassemblies of the connector shown in FIG. 1 connected to two respective electrical conductor cables.

Referring also to FIGS. 3-4, the union coupler assembly 16 generally comprises a coupling subassembly 42 which includes a first coupling body 44, a coupling sleeve 46 and a fastener 48, and a second coupling body or collet retainer 50. The members are made of a suitable material, such as steel for example. Referring also to FIG. 5, the coupling subassembly 42 is connected to the first collet housing 18 and the first wedge assembly 22 to form a first end subassembly 100 on the first conductor 12, and the second coupling body 50 is connected to the second collet housing 20 and the second wedge assembly 24 to form a second end subassembly 102 on the second conductor or conductor reinforcing core 14 (see FIG. 5). The two end subassemblies are adapted to be connected to each other to mechanically and electrically connect the conductors or conductor reinforcing cores 12, 14 to each other.

The first coupling body 44 comprises a first end 52 and a second end 54. The first end 52 forms a threaded shaft with a threaded section 56 and a first end surface 58. The second end 54 has a threaded hole 60 aligned with the threaded shaft of the first end 52. An exterior surface of the first coupling body 44 has flat sections 62. The flat sections 62 allow a tool, such as a wrench, to attach to the first coupling body 44 for axially rotating the first coupling body 44 and also for preventing the first coupling body 44 from axially rotating.

The coupling sleeve 46 has a general tube shape with a center channel 68. The coupling sleeve 46 has a first end 64 and a second end 66. The first end 64 is located against the second end 54 of the first coupling body 44. The center channel 68 has a smooth section at the first end 64, a threaded section at the second end 66, and a ledge between the threaded section and the smooth section. The exterior surface of the coupling sleeve 46 also has flat areas 70. The flat areas 70 allow a tool, such as a wrench, to attach to the coupling sleeve 46 for axially rotating the coupling sleeve 46.

The fastener 48 connects the coupling sleeve 46 to the first coupling body 44. In this embodiment the fastener 48 has a general bolt shape with a head 72 and a threaded shaft 74. The head 72 is circular and sized and shaped to be received inside the second end of the center channel 68 of the coupling sleeve 46. The head 72 can rest against the ledge inside the center channel 68 of the coupling sleeve 46. The end surface of the head 72 preferably has a recess for receiving a tool, such as a Allen wrench for example, for rotating the fastener when initially assembling the coupling subassembly 42. The threaded shaft 74 extends out of the center channel 68 of the coupling sleeve 46 at the first end 64 of the coupling sleeve 46. The threaded shaft 74 is screwed into the threaded hole 60 of the first coupling body 44. The fastener 48 rotatably attaches the coupling sleeve 46 to the first coupling body 44, but prevents the coupling sleeve 46 from substantially moving away from the first coupling body 44.

When the coupling subassembly 42 is connected to the first collet housing 18, the threaded section 56 is screwed into the threaded portion of the collet housing at the threaded inner end 25. As the first coupling body 44 is screwed into the collet housing 18, the surface 58 contacts the rear ends of the wedges 26 and pushes the wedge assembly 22 into the collet housing 18. Because of the tapered shape of the channel through the collet housing 18, this forces the wedges 26 to clamp onto the cable or conductor reinforcing core 12. The amount of clamping force is preferably not great enough to crush the cable or conductor reinforcing core 12 too much, and also not too little to allow easy pull-out of the cable or conductor reinforcing core 12 from the connector. The dimensions of the members could be designed to have the first coupling body 44 bottom out on connection to the collet housing 18 to provide this predetermined clamping force or be within a certain range. After the first coupling body 44 with the coupling sleeve 46 is connected to the first collet housing 18 with the first wedge assembly 22 and cable or conductor reinforcing core 12, the first end subassembly 100 is formed (see FIG. 5).

The second coupling body 50 generally comprises a first end 76 and a second end 78. The first end 76 comprises a threaded shaft. The second end 78 comprises a threaded shaft and an end surface 80 which is adapted to contact and push against a rear end of the second wedge assembly 24. The first end 76 is adapted to be screwed into the second end 66 of the coupling sleeve 46. The second end 78 is adapted to be screwed into the rear end 25 of the collet housing 20.

When the second coupling body 50 is connected to the second collet housing 20, the threaded section 78 is screwed into the threaded portion of the collet housing at the threaded inner end 25. An exterior surface of the second coupling body 50 has flat sections 82. The flat sections 82 allow a tool, such as a wrench, to attach to the second coupling body 50 for axially rotating the second coupling body 50 and also for preventing the second coupling body 50 from axially rotating. As the second coupling body 50 is screwed into the collet housing 20, the surface 80 contacts the rear ends of the wedges 26 and pushes the wedge assembly 24 into the collet housing 20. Because of the tapered shape of the channel through the collet housing 20, this forces the wedges 26 to clamp onto the cable or conductor reinforcing core 14. The amount of clamping force is preferably not great enough to crush the cable or conductor reinforcing core 14 too much, and also not too little to allow easy pull-out of the cable or conductor reinforcing core 14 from the connector. The dimensions of the members could be designed to have the second coupling body 50 bottom out on connection to the collet housing 20 to provide this predetermined clamping force or be within a certain range. After the second coupling body 50 is connected to the second collet housing 20 with the second wedge assembly 24 and cable or conductor reinforcing core 14, the second end subassembly 102 is formed (see FIG. 5).

Referring also to FIG. 5, with the two end subassemblies 100, 102 connected to the two cables or conductor reinforcing cores 12, 14, the two subassemblies 100, 102 can be connected to each other to thereby mechanically and electrically connect the cables or conductor reinforcing cores 12, 14 to each other. The first end 76 of the second coupling body 50 is screwed into the second end 66 of the coupling sleeve 46. During this attachment, neither the first coupling body 44 nor the second coupling body 50 needs to be axially rotated. Instead, the coupling sleeve 46 is axially rotated to screw the first end 76 of the second coupling body 50 into the second end 66 of the coupling sleeve 46. The connection of the coupling sleeve 46 to the first coupling body 44 allows the coupling sleeve 46 to axially rotate without the coupling sleeve moving away from the first coupling body 44. Thus, the second coupling body 50 can be pulled towards the first coupling body 44 to thereby move the two cables or conductor reinforcing cores 12, 14 towards each other; taking up slack between the lines 12, 14. Because the coupling sleeve 46 is free to axially rotate relative to the first coupling body 44, the first coupling body 44 is prevented from inadvertently unscrewing from the first collet housing 18 while the coupling sleeve 46 is being screwed onto the second coupling body 50. FIG. 1 shows the final assembly.

In the event that the cables 12, 14 need to be disconnected from each other, the coupling sleeve 46 can be unscrewed from the second coupling body 50 without unscrewing the two coupling bodies 44, 50 from their subassemblies 100, 102. Thus, there is no need to interfere or disrupt the clamping provided by the subassemblies on the cables or conductor reinforcing cores 12, 14. The subassemblies 100, 102 can be reassembled at a later time without having to reset the clamping of the subassemblies on the cables or conductor reinforcing cores.

The conventional turnbuckle design has caused some problems in the field in that customers have disassembled the pre-assembled part (a coupling body screwed and glued into a coupling sleeve) and then re-assembled it incorrectly such that they pre-engage a right hand side. Left hand threaded parts will then not engage the remaining right hand threaded components, causing confusion. Another potential fault in the turnbuckle design is that if the turnbuckle sleeve is assembled incorrectly at the factory, or if the customer turns the sleeve many turns down the left hand thread, before the conductor segments are coupled, there may not be enough threads engaged to properly hold the two cable segments at "full tension" when the coupling of the two segments is completed.

The union style coupling design of the invention can consist of only four components. The union style coupler of the invention does not have a left hand thread (which has confused customers in the conventional turnbuckle design with the customers trying to re-assemble the existing design after they have taken it apart). The union style coupler of the invention will be very difficult to disassemble in the field because it is unlikely that linemen will have the special tool required to remove the shoulder bolt 48. With the invention, part 46 freely rotates about shoulder bolt 48, so when part 46 is rotated, only collet retainer 50 is drawn into part 46. Similarly, when part 44 is rotated, parts 44 and 58 rotate, but parts 46 and 50 can be held stationary. Independent coupling of the invention is better because the wedge-type connector end subassemblies can be attached to the two cable ends with parts 44 and 50 being screwed into the collet housings to press the wedges on the cables or conductor reinforcing cores 12, 14, and subsequently the ends of the cables can be coupled together by the body 46 without decreasing or increasing the pressure on the wedges and cables in either of the wedge-type connector end subassemblies.

In an alternate embodiment one or more of the collet assemblies 22, 24 could be removed and the collet housing(s) 18 and/or 20 replaced by a threaded crimp sleeve. In another alternate embodiment items 44 and 50 could be changed such that features 52 and 78 would be crimp tubes instead of threaded shafts.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector union coupler assembly comprising:

a coupling subassembly comprising a coupling sleeve rotatably connected to a coupling body, wherein the coupling body comprises a first end with a threaded section and a first surface adapted to press against a first set of electrical connector wedges, wherein the coupling sleeve is constrained on the coupling body for substantially only rotational movement relative to the coupling body; and a collet retainer having a first end movably connected to the coupling sleeve by a threaded connection, wherein the collet retainer comprises a second end with a threaded section and a second surface adapted to press against a second set of electrical connector wedges.

2. An assembly as in claim 1 wherein the coupling subassembly further comprises a bolt extending through the coupling sleeve and fixedly attached to the coupling body, wherein the coupling sleeve is rotatably mounted on the bolt.

3. An assembly as in claim 1 wherein the coupling sleeve comprises a channel therethrough, wherein a first end of the channel is substantially smooth and a second end of the channel is threaded.

4. An assembly as in claim 1 wherein a first end of the coupling sleeve is rotatably connected to a second end of the coupling body, and wherein a second end of the coupling sleeve has a threaded hole which receives the first end of the collet retainer therein.

5. An assembly as in claim 1 wherein the coupling subassembly further comprises a fastener connecting a first end of the coupling sleeve to a second end of the first coupling body, wherein the coupling sleeve is adapted to rotate relative to the coupling body and is substantially prevented from moving away from the coupling body by the fastener.

6. An assembly as in claim 1 wherein the coupling sleeve, the coupling body and the collet retainer each comprise an exterior tool mounting surface adapted to attach a tool thereto for axially rotating the coupling sleeve, the coupling body and the collet retainer.

7. An electrical connector comprising:

an electrical connector union coupler assembly as in claim 1;

a first collet housing connected to the threaded section of the coupling body;

the first set of wedges located in the first collet housing and contacted by the first surface of the coupling body;

a second collet housing connected to the threaded section of the collet retainer; and the second set of wedges located in the second collet housing and contacted by the second surface of the collet retainer.

8. An electrical connector union coupler assembly comprising:

a first coupling body comprising a first end and a second end, wherein the first end comprises a threaded section and a surface adapted to press against a first set of electrical connector wedges;

a coupling sleeve having a first end and a second end, wherein the second end comprises a threaded section;

a fastener connecting the first end of the coupling sleeve to the second end of the first coupling body, wherein the coupling sleeve is adapted to rotate relative to the coupling body and is substantially prevented from moving away from the coupling body by the fastener; and a second coupling body having a first end adapted to be screwed into the second end of the coupling sleeve, and a second end having a threaded section and a surface adapted to press against a second set of electrical connector wedges.

9. An assembly as in claim 8 wherein the fastener comprises a bolt fixedly mounted to the second end of the first coupling body and having the coupling sleeve rotatably mounted thereon.

10. An assembly as in claim 8 wherein the coupling sleeve comprises a channel therethrough, wherein a first end of the channel is substantially smooth and a second end of the channel is threaded.

11. An assembly as in claim 8 wherein the coupling sleeve, the first coupling body and the second coupling body each comprise an exterior tool mounting surface adapted to attach a tool thereto for axially rotating the coupling sleeve, the first coupling body and the second coupling body.

12. An electrical connector comprising:

an electrical connector union coupler assembly as in claim 8;

a first collet housing connected to the threaded section on the first end of the first coupling body;

the first set of wedges located in the first collet housing and contacted by the surface on the first end of the first coupling body;

a second collet housing connected to the threaded section on the second end of the second coupling body; and the second set of wedges located in the second collet housing and contacted by the surface on the second end of the second coupling body.

13. An electrical splice connector comprising:

a first end subassembly adapted to be connected to an end of a first electrical conductor cable or conductor reinforcing core, wherein the first end subassembly comprises a first set of wedges adapted to be compressed around the end of the first electrical conductor cable or conductor reinforcing core; and a second end subassembly adapted to be connected to an end of a second electrical conductor cable or conductor reinforcing core, wherein the second end subassembly comprises a second set of wedges adapted to be compressed around the end of the second electrical conductor cable or conductor reinforcing core, wherein the first and second end subassemblies are adapted to be connected to each other such that a first portion of the first end subassembly can be rotated relative to a second portion of the first end subassembly and relaive to the second end subassembly, wherein the first portion comprises a coupling sleeve rotatably connected to a first coupling body, wherein the second portion comprises a second coupling body, and wherein rotation of the coupling sleeve moves the first and second coupling bodies towards each other without moving the sets of wedges in their respective subassemblies.

14. An electrical splice connector as in claim 13 wherein the first end subassembly comprises a first collet housing connected to the first coupling body, wherein the first set of wedges are located in the first collet housing and the first coupling body comprises an end adapted to contact ends of the first set of wedges and press the first set of wedges into the first collet housing.

15. An electrical splice connector as in claim 14 wherein the second end subassembly comprises a second collet housing connected to the second coupling body, wherein the second set of wedges are located in the second collet housing and the second coupling body comprises an end adapted to contact ends of the second set of wedges and press the second set of wedges into the second collet housing.

16. An electrical splice connector as in claim 13 wherein the coupling sleeve is adapted to be rotated relative to the first coupling body without moving away from the first coupling body, and wherein the second end subassembly comprises a second coupling body connected to the coupling sleeve by a threaded connection.

* * * * *